US009859688B1

(12) United States Patent
Gerstner et al.

(10) Patent No.: US 9,859,688 B1
(45) Date of Patent: Jan. 2, 2018

(54) REMANUFACTURED SPARKPLUG AND SPARKPLUG REMANUFACTURING METHOD

(71) Applicant: Caterpillar Inc., Peoria, IL (US)

(72) Inventors: Michael Gerstner, Peoria, IL (US); Timothy Graham, Golden, MS (US); Dianqi Fang, Dunlap, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 15/212,078

(22) Filed: Jul. 15, 2016

(51) Int. Cl.
*H01T 13/20* (2006.01)
*H01T 21/02* (2006.01)
*F02F 1/24* (2006.01)

(52) U.S. Cl.
CPC ..... *H01T 13/20* (2013.01); *F02F 1/242* (2013.01); *H01T 21/02* (2013.01)

(58) Field of Classification Search
CPC ..... H01T 13/20; H01T 21/02; F02F 1/242
See application file for complete search history.

(56) References Cited

U.S. PATENT DOCUMENTS

| | | | | |
|---|---|---|---|---|
| 5,623,179 | A * | 4/1997 | Buhl | H01T 13/467 313/141 |
| 6,589,091 | B2 | 7/2003 | Harada | |
| 6,790,113 | B1 | 9/2004 | Fujita | |
| 6,928,984 | B1 | 8/2005 | Shamine | |
| 7,296,474 | B2 | 11/2007 | Shamine | |
| 2009/0072694 | A1 * | 3/2009 | Steigleman, Jr. | H01T 21/02 313/118 |

FOREIGN PATENT DOCUMENTS

| | | |
|---|---|---|
| DE | 202011003816 | 6/2011 |
| EP | 0540159 | 5/1993 |
| EP | 2525452 | 11/2012 |

* cited by examiner

*Primary Examiner* — Joseph L Williams

(57) ABSTRACT

A remanufactured sparkplug includes a housing, an insulator within the housing, and first and second electrodes. The first electrode and the second electrode form a plurality of spark gaps at a plurality of new spark gap locations, and a plurality of spark-induced erosions are formed in the second electrode at a plurality of former spark gap locations that are circumferentially offset from the new spark gap locations.

20 Claims, 3 Drawing Sheets

REMANUFACTURED SPARKPLUG AND SPARKPLUG REMANUFACTURING METHOD

TECHNICAL FIELD

The present disclosure relates generally to the fields of remanufacturing and salvaging, and more particularly to remanufacturing a used sparkplug to form spark gaps at new spark gap locations circumferentially offset from former spark gap locations.

BACKGROUND

The fields of remanufacturing and salvaging have grown tremendously in recent decades. Systems and parts that were once considered to have no value greater than scrap are often now returned to service in a state and to specifications as good as or better than new. In some instances, it is only necessary to clean up and inspect a used machine component to determine suitability for further service. The presence of cracks, spalling, fretting, dimensional changes, deformation, and a host of other types of damage or wear can affect whether a component can be successfully returned to service, with or without repair. Modern technologies have been developed to address many of the types of damage and wear that are observed in components, such as engine components and machinery components. While repair of damage and wear provides an effective strategy for remanufacturing certain component types, other used components have defied repair despite a host of sophisticated available technologies.

In the case of sparkplugs, use of the sparkplug over millions or even billions of operating cycles can actually cause material of the electrodes to erode and/or dissipate, creating challenges for successful reuse that have defied attempts at remanufacturing. German Patent Reference DE202011003816U1 depicts one example strategy for sparkplug gap setting, where it appears some compensation for eroded electrode material is proposed thereby allowing the sparkplug to be returned to service. While this and other gap-setting techniques might extend the service life of a sparkplug somewhat, there is ample room for improvement.

SUMMARY OF THE INVENTION

In one aspect, a remanufactured sparkplug includes a housing defining a center axis, and an insulator positioned at least partially within the housing. This sparkplug further includes a first electrode supported by the insulator, and including a plurality of electrode prongs spaced circumferentially about the center axis and each including an electrode tip, and a second electrode including an electrode surface extending about the center axis and radially spaced from each of the plurality of electrode tips to form a plurality of spark gaps at a plurality of new spark gap locations. The electrode surface has formed therein a plurality of spark-induced erosions at a plurality of former spark gap locations that are circumferentially offset from the plurality of new spark gap locations about the center axis.

In another aspect, a method of remanufacturing a used sparkplug includes receiving a sparkplug removed from service in an engine and including a first electrode having a plurality of prongs including a plurality of electrode tips forming spark gaps with a second electrode. The method further includes disassembling the sparkplug such that an angular orientation of a first electrode about a center axis of the sparkplug relative to the second electrode can be adjusted. The method further includes adjusting the angular orientation such that the electrode tips form spark gaps with the second electrode at a plurality of new spark gap locations offset from a plurality of former spark gap locations of the second electrode. The method still further includes reassembling the sparkplug.

In still another aspect, a remanufactured cylinder head assembly includes a cylinder head structured to couple with an engine block in an internal combustion engine system, and including a fire side surface and a second surface opposite the fire side surface, and having a bore formed therein and communicating between the fire side surface and the second surface. The assembly further includes a remanufactured sparkplug positioned within the bore, the remanufactured sparkplug defining a center axis and including a first electrode having a plurality of prongs spaced circumferentially about the center axis and each including an electrode tip, and a second electrode having an electrode surface forming a plurality of spark gaps with the electrode tips of the plurality of electrode prongs. The spark gaps are formed at a plurality of new spark gap locations, and the electrode surface further has formed therein a plurality of spark-induced erosions at a plurality of former spark gap locations offset from the plurality of new spark gap locations.

DETAILED DESCRIPTION

Figure 1:
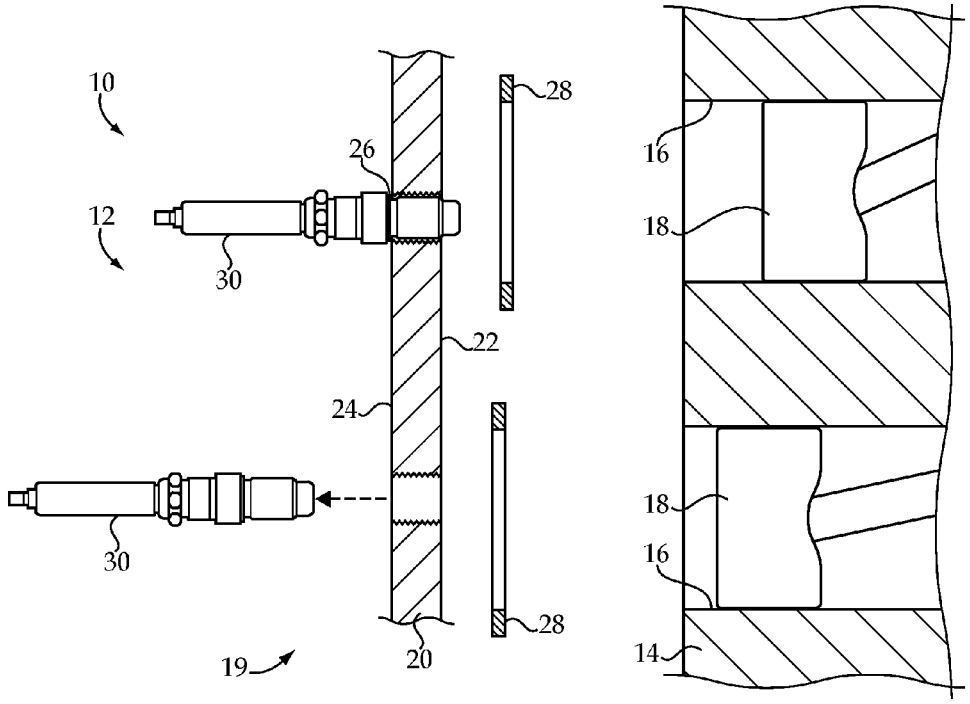
FIG. 1 is a partially sectioned diagrammatic side view of an assembly, according to one embodiment.

Engine 12 includes a spark-ignited engine such as a natural gas or gasoline spark-ignited engine. Engine 12 is equipped also with a cylinder head assembly including a cylinder head 20 having a fire side surface 22, and an opposite second surface 24. Cylinder head assembly 19 also includes one or more sparkplugs 30 each positioned within a bore 26 that communicates between fire side surface 22 and second surface 24. A head gasket 28, or a plurality of separate head gaskets, is positioned for clamping between engine housing 14 and cylinder head 20. One or more of the sparkplugs 30 may be a used sparkplug that has been remanufactured, thus cylinder head assembly 19 can be a remanufactured cylinder head assembly 19. Other parts of cylinder head assembly 19 may be remanufactured, refurbished, repaired, or cylinder head 20 and other components of cylinder head assembly 19 apart from sparkplugs 30 might be new. As will be further apparent from the following description, the present disclosure contemplates unique strategies for sparkplug remanufacturing considered to enable reuse of sparkplugs in situations where the sparkplugs would formerly have been scrapped.

Figure 2:
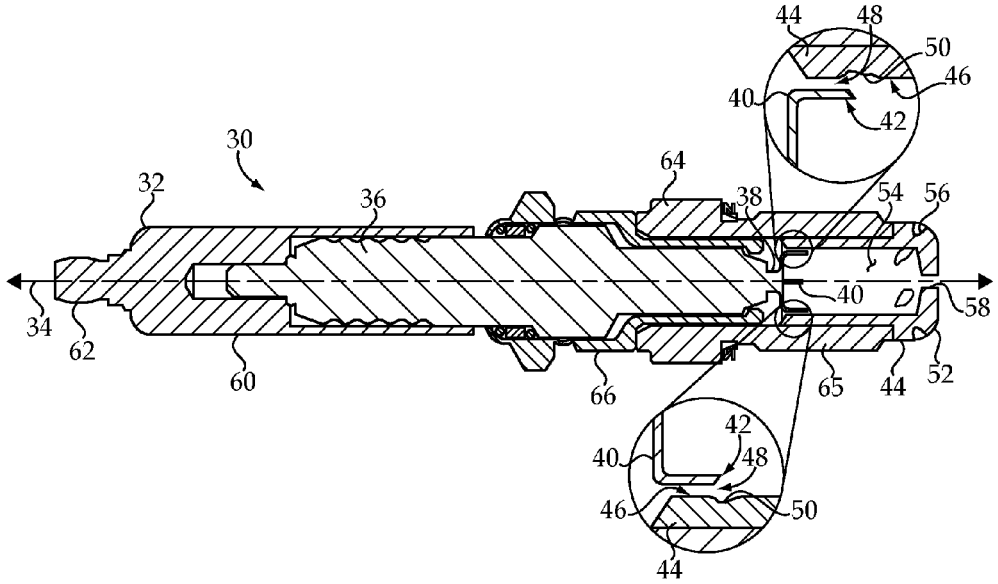
FIG. 2 is a sectioned side diagrammatic view, including detailed enlargements, of a sparkplug removed from service in an engine.

Referring also now to FIG. 2, there is shown a sparkplug 30 as it might appear having been removed from service in an engine such as engine 12 and prior to being remanufactured. As many of the components of sparkplug 30 will be the same components that are reused when sparkplug 30 is returned to service, except where otherwise indicated descriptions herein of a sparkplug can be taken to refer to a used sparkplug not yet remanufactured as well as a sparkplug after having been remanufactured. Sparkplug 30 includes a housing 32 defining a center axis 34. An insulator 36 is positioned at least partially within housing 32, and a first electrode 38 is supported by insulator 36. Electrode 38 includes a plurality of electrode prongs 40 spaced circumferentially about center axis 34. Each of prongs 40 includes an electrode tip 42. Sparkplug 30 further includes a second electrode 44 having an electrode surface 46 extending about center axis 34 and radially spaced from each of the plurality of electrode tips 42 to form a plurality of spark gaps 48. In the FIG. 2 illustration, spark gaps 48 may be understood to be at a plurality of former spark gap locations, the significance of which will be further apparent from the following description.

Sparkplug 30 may further include a first end cap 60 that includes or is coupled with an electrical terminal 62 structured to connect with an engine electrical system (not shown) in a conventional manner. Insulator 36 may be received within first end cap 60. Sparkplug 30 also includes an insulator support piece 66, and a cylinder head connector piece 64. Cylinder head connector piece 64 includes an external thread 65 for coupling with cylinder head 20 in engine 12. In the illustrated embodiment, second electrode 44 includes a ground electrode formed by a second end cap 52 of sparkplug 30. Electrode surface 46 may include an inside surface of end cap 52, as shown in the detailed enlargements of FIG. 2. In a further practical implementation strategy, end cap 52 defines a prechamber 54, and spark gaps 48 are located within prechamber 54. It can also be noted that insulator support piece 66 is coupled with cylinder head connector piece 64 and has insulator 36 and first electrode 38 positioned at least partially therein. Prongs 40 can be seen to project radially outward of center axis 34. In a practical implementation strategy, end cap 52 is interference fitted within cylinder head connector piece 64, and a plurality of fluid openings including side openings 56 and an end opening 58 are formed in end cap 52 and structured for conveying combustible gases and/or combusted gases into or out of prechamber 54.

As noted above, spark gaps 48 are understood to be located at a plurality of former spark gap locations. During remanufacturing, new spark gaps will be established at a plurality of new spark gap locations that are circumferentially offset from the plurality of former spark gap locations about center axis 34. It has been observed that an electrode surface such as surface 46 can exhibit spark-induced erosions at locations of the spark gaps. Over the course of operating cycles that can number in the millions or the billions, sparks produced between electrodes 38 and 44 can cause material of the electrodes to erode. When a sparkplug such as sparkplug 30 is removed from service, a plurality of spark-induced erosions 50 can be seen at the former spark gap locations. Erosion of prongs 40 can also be observed, and depending upon the particular electrode and electrode tip or prong design, erosion of the electrode tips can progress in an axial direction, hence the slightly different axial lengths and shapes of tips 42 and prongs 40 that can be seen in FIG. 2.

Figure 3:
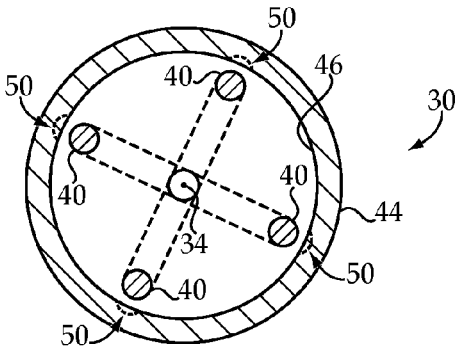
FIG. 3 is an axial sectioned view of the sparkplug of FIG. 2.

Referring also now to FIG. 3, there are shown erosions 50 spaced circumferentially about center axis 34 at approximately 90 degree intervals, corresponding to 90 degree spacing among prongs 40. In other sparkplug designs, spacing of electrode tips and/or electrode prongs may be different from that of the illustrated embodiment, and in such designs the particular remanufacturing procedures may differ as further discussed herein.

Figure 4:
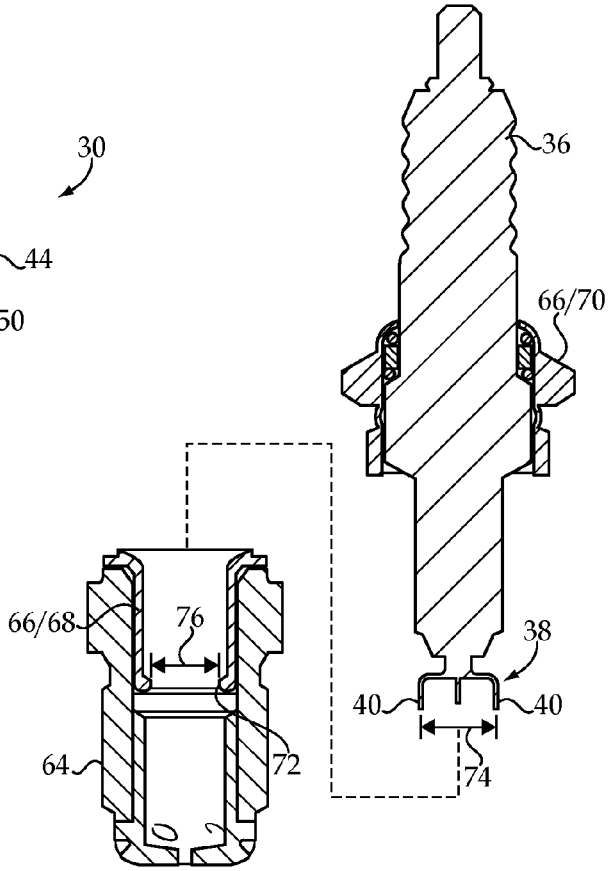
FIG. 4 is a partially disassembled view of a sparkplug at one stage of remanufacturing, according to one embodiment.

Referring now to FIG. 4, there are shown components of sparkplug 30 having been disassembled at a remanufacturing stage. It can be seen that insulator support piece 66 has been cut at an axial location to separate piece 66 into a first axial piece 68, and a second axial piece 70. First axial piece 68 remains interference fitted within cylinder head connector piece 64. Second axial piece 70 remains coupled with, and can be interference fitted with, insulator 36. An annular weld can be later formed, as further discussed herein, to reattach first axial piece 68 to second axial piece 70. Insulator support piece 66 may define a bore or opening 72 centered on center axis 34. An outer diameter dimension 74 defined by prongs 40 may be greater than an inner diameter dimension 76 defined by opening 72 when sparkplug 30 is removed from service in an engine. Accordingly, prongs 40 may be deformed slightly as insulator 36 and thus electrode 38 is pulled out of second axial piece 70 by way of opening 72. As further described herein, opening 72 may be modified by way of machining so that outer diameter dimension 74 is less than inner diameter dimension 76 for reassembly of the component shown in FIG. 4 and upon completion of remanufacturing of sparkplug 30.

Figure 5:
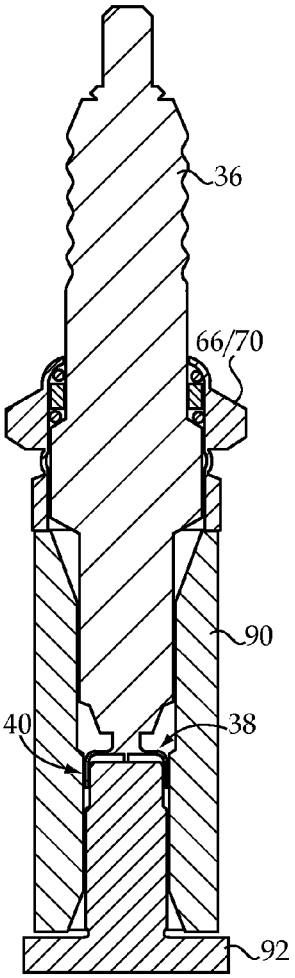
FIG. 5 is a diagrammatic view of the sparkplug at another stage of remanufacturing.

Referring now to FIG. 5, there is shown insulator support piece 66 positioned within a fixture 90, and where a ram 92 has been inserted into fixture 90 and positioned against first electrode 38 in a manner so as to bend prongs 40 outwardly back to a specified dimension. Those skilled in the art will be familiar with the relative specificity of certain dimensions in modern machine parts, with spark gaps being relatively strictly specified. Accordingly, prongs 40 can be bent by way of ram 92 so as to be positioned to provide new spark gaps having a specified diameter. In one practical implementation strategy, prongs 40 can be bent between and squeezed between fixture 90 and an outer surface of ram 92. Deforming prongs 40 in this general manner can in some instances compensate for erosion of prongs 40, more particularly electrode tips 42, that is spark-induced. In other words, it has been observed that spark gap distance can increase with erosion of the material of not only second electrode 44 but also first electrode 38, and deformation of prongs 40 can compensate for such spark-induced erosion.

Figure 6:
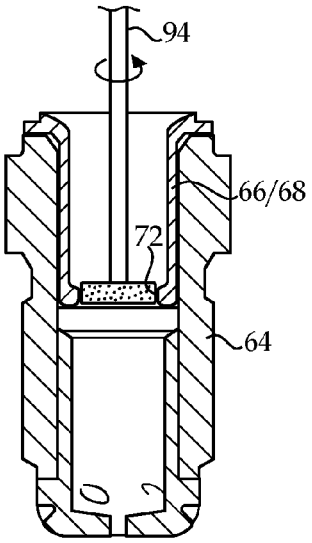
FIG. 6 is a diagrammatic view of the sparkplug at another stage of remanufacturing.

Referring now to FIG. 6, there is shown axial piece 70 coupled with cylinder head connector piece 64 as it might appear where a machining tool 94 has been inserted into second axial piece 70 and used to enlarge the diameter of opening 72. It will thus be understood that adjustments to prongs 40 achieved by way of fixture 90 and ram 92, or by way of some other technique, can be preserved since opening 72 is now sufficiently large to accept prongs 40 therethrough without requiring deformation.

Figure 7:
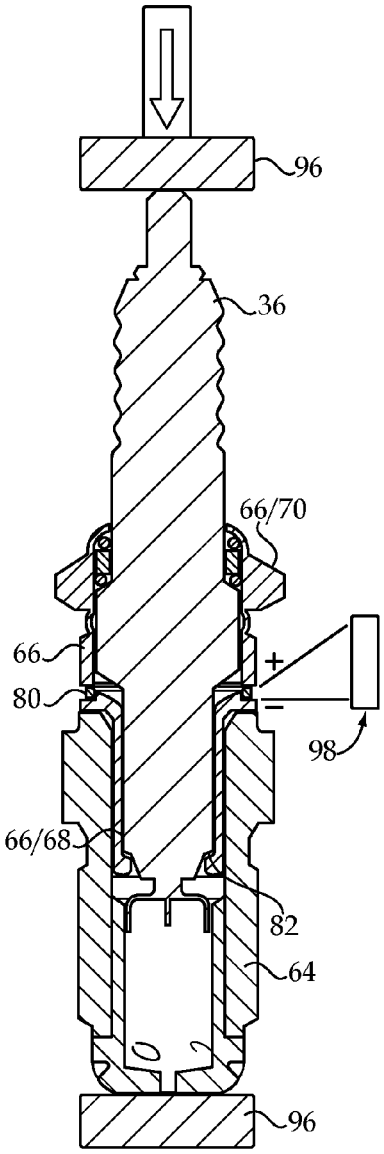
FIG. 7 is a diagrammatic view of the sparkplug at yet another stage of remanufacturing.
Figure 8:
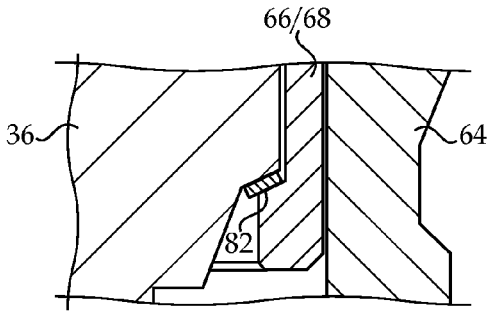
FIG. 8 is a sectioned view of a portion of the sparkplug.
Figure 9:
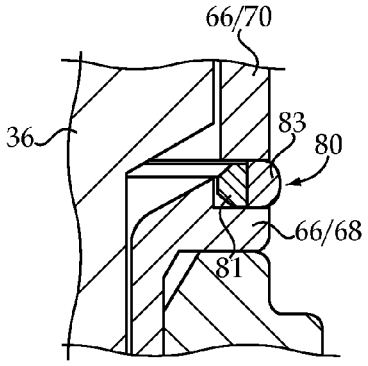
FIG. 9 is a sectioned view of another portion of the sparkplug.

Referring to FIG. 7, there is shown sparkplug 30 as it might appear and having been positioned within a fixturing and force producing device 96 that will axially compress or bias insulator support piece 36 against second axial piece 70 of insulator support piece 66. A welding mechanism 98 is also shown positioned as it might appear to form an annular weld 80 irreversibly connecting first axial piece 68 and second axial piece 70. Referring also to FIG. 9, there is shown a close-up view of annular weld 80 being formed to connect first axial piece 68 and second axial piece 70. A spacer 81 or the like can be positioned between first axial piece 68 and second axial piece 70, and a weld material 83 provided that metallurgically bonds with spacer 81 and with first axial piece 68 and second axial piece 70. In FIG. 8, a crush washer 82 is shown. It will be recalled that insulator support piece 36 is biased against second axial piece 70. In one practical implementation strategy, crush washer 82 may start out having an annular shape, and a downward force used to deform crush washer 82 to a generally conical shape approximately as shown in FIG. 8. After completion of the welding procedure depicted at FIG. 7, remanufacturing of sparkplug 30 may be substantially complete. First end cap 60 may be reinstalled to insulator 36, and sparkplug 30 returned to service as a remanufactured sparkplug.

Figure 10:
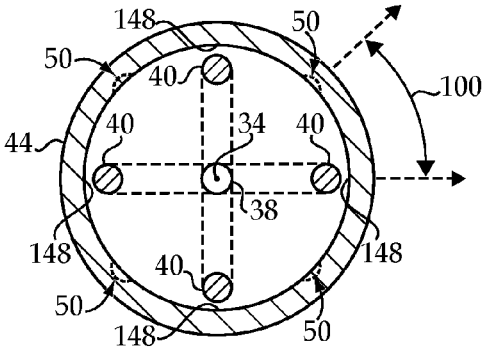
FIG. 10 is an axial sectioned view of the sparkplug having been remanufactured.

Referring to FIG. 10, there is shown an axial section view that illustrates certain of the features of sparkplug 30 as they might appear after remanufacturing. It will be recalled that spark-induced erosions 50 may reside at a plurality of former spark gap locations. Electrode tips 42 of prongs 40 may be positioned so as to form a plurality of new spark gaps 148 at a plurality of new spark gap locations. An angular displacement of spark-induced erosions 50 and thus the former spark gap locations from new spark gaps 148 and thus the new spark gap locations might be about 45 degrees. In the embodiment illustrated in FIG. 10, a number of prongs 40 is equal to a number of erosions 50, which number in either case is equal to four. Virgin material of end cap 52 can be located at each of the plurality of new spark gap locations, and used material can be located at each of the plurality of former spark gap locations. The angular displacement between former spark gap locations and new spark gap locations is shown by way of angle 100 in FIG. 10.

Figure 11:
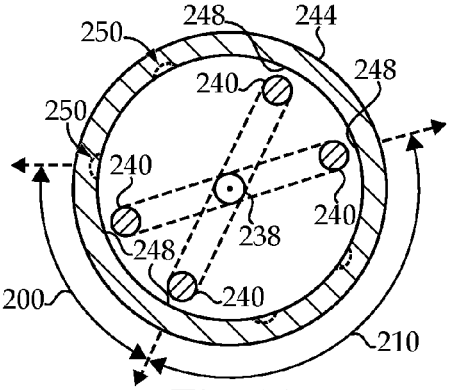
FIG. 11 is an axial sectioned view of a sparkplug having been remanufactured, according to another embodiment.

Referring to FIG. 11, there is shown an axial section view through another sparkplug according to a different design, and having an electrode 238 that includes a plurality of prongs 230 radially spaced inward from a second electrode 234 so as to form a plurality of spark gaps 248. Spark gaps 248 may include new spark gaps at a plurality of new spark gap locations that are offset from a plurality of spark-induced erosions 250 at former spark gap locations. In contrast to the embodiment depicted in FIG. 10, electrode 238 may have a different configuration, where prongs 240 are separated from one another by a smaller angle, and a larger angle shown by way of angle 210 that might be equal to about 120 degrees. An angle 200 representing an angular displacement between erosions 250 and thus former spark gap locations and prongs 240 and thus new spark gap locations may be about 90 degrees.

INDUSTRIAL APPLICABILITY

Referring to the drawings generally, when a sparkplug such as sparkplug 30 is removed from service in an engine it may include a plurality of former spark gaps that are degraded in function or reliability, or simply out of specification. The sparkplug may be disassembled such that an angular orientation of a first electrode such as electrode 38 can be adjusted relative to a second electrode such as electrode 44. Remanufacturing may include adjusting the angular orientation, such as by disassembling the parts as described herein, and reassembling them at an adjusted angular orientation as described herein, so as to form spark gaps between electrode tips of the first electrode and an electrode surface of the second electrode at a plurality of new spark gap locations offset from the former spark gap locations. Some or all of the former spark gap locations may be identified by the presence of spark-induced erosions. In one embodiment, the plurality of new spark gap locations are in an alternating arrangement with the plurality of former spark gap locations, however, the present disclosure is not limited to such a configuration.

As described herein, the electrode prongs may be positioned radially inward of the second electrode, such that producing the circumferential offset of the prongs relative to the spark-induced erosions can be achieved by rotating the plurality of prongs relative to the erosions. In the illustrated embodiment, this includes rotating insulator support piece 66 relative to cylinder head connector piece 64. In some instances, potentially subject to manual or machine inspection, electrode prongs may be bent in a radially outward direction by way of positioning the insulator support piece in a fixture and inserting a ram as described herein. While a number of the prongs may be four, the present disclosure is not thereby limited. Analogously, while adjusting the first electrode relative to the second electrode may include adjusting by about 45 degrees from a first angular orientation to a second angular orientation, the present disclosure is also not limited in this regard. Referring back to FIG. 4, it will be recalled that prongs 40 may be withdrawn through a bore, such as opening 72, in one of the parts of housing 32 of sparkplug 30. Reassembling sparkplug 30 may include passing prongs 40 back through bore or opening 72, but only after bore or opening 72 has been enlarged prior to reassembly.

It can also be appreciated that insulator support piece 66 can be cut into a first axial piece coupled with insulator 36 and supporting electrode 38, and a second axial piece 70 coupled with second electrode 44 and having opening or bore 72 formed therein, however, the present disclosure is also not limited in this regard. Different sparkplug designs may lend themselves to different types or strategies for remanufacturing, but still be amenable to the technique of adjusting angular orientation of one electrode relative to another electrode. In some instances, rather than adjusting one electrode relative to another electrode by a rotation that places new spark gaps approximately half-way between former spark gaps, the rotation could be less so as to preserve virgin material of the electrodes for subsequent remanufacturing and additional service lives. In other words, rather than angle 100 being about 45 degrees, angle 100 might be about 20 degrees a first time that sparkplug 30 is remanufactured. The next time sparkplug 30 is remanufactured an additional relative rotation might be undertaken to reposition the electrodes again. Those skilled in the art will therefore appreciate a great variety of different possible strategies, depending upon both the desires and intents of remanufacturing as well as the particular design of a given sparkplug.

The present description is for illustrative purposes only, and should not be construed to narrow the breadth of the present disclosure in any way. Thus, those skilled in the art will appreciate that various modifications might be made to the presently disclosed embodiments without departing from the full and fair scope and spirit of the present disclosure.

Other aspects, features and advantages will be apparent from an examination of the attached drawings and appended claims.

What is claimed is:

1. A remanufactured sparkplug comprising:

a housing defining a center axis:

an insulator positioned at least partially within the housing:

a first electrode supported by the insulator, and including a plurality of electrode prongs spaced circumferentially about the center axis and each including an electrode tip; and a second electrode including an electrode surface extending about the center axis and radially spaced from each of the plurality of electrode tips to form a plurality of spark gaps at a plurality of new spark gap locations;

the electrode surface further having formed therein a plurality of spark-induced erosions at a plurality of former spark gap locations that are circumferentially offset from the plurality of new spark gap locations.

2. The sparkplug of claim 1 wherein the second electrode includes a ground electrode formed by an end cap of the sparkplug, and the electrode surface includes an inside surface of the end cap.

3. The sparkplug of claim 2 wherein the end cap defines a prechamber, and the plurality of spark gaps are located within the prechamber.

4. The sparkplug of claim 2 wherein the end cap includes virgin material at each of the plurality of new spark gap locations, and used material at each of the plurality of former spark gap locations.

5. The sparkplug of claim 4 wherein a number of the plurality of electrode prongs is equal to a number of the plurality of spark-induced erosions.

6. The sparkplug of claim 2 wherein the housing further includes a cylinder head connector piece including an external thread for coupling with a cylinder head in an engine, and an insulator support piece coupled with the cylinder head connector piece and having the insulator and first electrode positioned at least partially therein.

7. The sparkplug of claim 6 wherein the plurality of prongs project radially outward of the center axis, and wherein the insulator support piece defines an opening centered on the center axis and an outer diameter dimension defined by the plurality of prongs is less than an inner diameter dimension defined by the opening.

8. The sparkplug of claim 6 wherein the insulator support piece has a first axial piece interference fitted within the cylinder head connector piece, a second axial piece, and an annular weld attaching the first axial piece to the second axial piece.

9. The sparkplug of claim 8 wherein the end cap is interference fitted within the cylinder head connector piece, and projects axially outward of the cylinder head connector piece, and wherein a plurality of fluid openings for conveying gases into or out of the prechamber are formed in the end cap.

10. The sparkplug of claim 1 wherein the plurality of new spark gap locations are in an alternating arrangement with the plurality of former spark gap locations.

11. A method of remanufacturing a used sparkplug comprising:

receiving a sparkplug removed from service in an engine and including a first electrode having a plurality of prongs including a plurality of electrode tips forming spark gaps with a second electrode;

disassembling the sparkplug such that an angular orientation of the first electrode about a center axis of the sparkplug relative to the second electrode can be adjusted;

adjusting the angular orientation such that the electrode tips form spark gaps with the second electrode at a plurality of new spark gap locations offset from a plurality of former spark gap locations of the second electrode; and reassembling the sparkplug.

12. The method of claim 11 wherein the receiving of the sparkplug further includes receiving a sparkplug where the second electrode has a plurality of spark-induced erosions at the plurality of former spark gap locations.

13. The method of claim 12 wherein the plurality of prongs are positioned radially inward of the second electrode, and wherein the adjusting of the first electrode further includes rotating the plurality of prongs relative to the plurality of spark-induced erosions.

14. The method of claim 13 further comprising positioning an insulator supporting the first electrode in a fixture, and inserting a ram into a bore in the fixture so as to bend the plurality of prongs in a radially outward direction.

15. The method of claim 14 wherein a number of the plurality of prongs is four, and the adjusting of the first electrode further includes adjusting the first electrode about 45 degrees from the first angular orientation to the second angular orientation.

16. The method of claim 11 wherein the disassembling of the sparkplug further includes withdrawing the prongs through a bore in a housing of the sparkplug.

17. The method of claim 16 wherein the reassembling of the sparkplug further includes passing the prongs back through the bore, and further comprising enlarging the bore prior to the reassembling of the sparkplug.

18. The method of claim 17 further comprising:

cutting an insulator support piece of the housing into a first axial piece coupled with an insulator supporting the first electrode, and a second axial piece coupled with the second electrode and having the bore formed therein, prior to the disassembling of the sparkplug; and welding the first axial piece to the second axial piece, after the reassembling of the sparkplug.

19. A remanufactured cylinder head assembly comprising:

a cylinder head structured to couple with an engine block in an internal combustion engine system, and including a fire side surface and a second surface opposite the fire side surface, and having a bore formed therein and communicating between the fire side surface and the second surface;

a remanufactured sparkplug positioned within the bore, the remanufactured sparkplug defining a center axis and including a first electrode having a plurality of prongs spaced circumferentially about the center axis and each including an electrode tip, and a second electrode having an electrode surface forming a plurality of spark gaps with the electrode tips of the plurality of electrode prongs; and the spark gaps being formed at a plurality of new spark gap locations, and the electrode surface further having formed therein a plurality of spark-induced erosions at a plurality of former spark gap locations offset from the plurality of new spark gap locations.

20. The remanufactured cylinder head assembly of claim 19 wherein the plurality of new spark gap locations are in an alternating arrangement with the plurality of former spark gap locations on an inside wall of an end cap of the sparkplug forming a combustion prechamber.

* * * * *